US008237069B2

(12) United States Patent
GaleWyrick et al.

(10) Patent No.: US 8,237,069 B2
(45) Date of Patent: Aug. 7, 2012

(54) CONTROL BUTTON HAVING A SINGLE RETURN SPRING FOR MULTIPLE BUTTONS

(75) Inventors: Seth McCue GaleWyrick, Asheville, NC (US); Andrew Weiman, Langhorne, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 169 days.

(21) Appl. No.: 12/643,126

(22) Filed: Dec. 21, 2009

(65) Prior Publication Data

US 2011/0147190 A1 Jun. 23, 2011

(51) Int. Cl.
*H01H 9/26* (2006.01)

(52) U.S. Cl. ..... 200/5 B

(58) Field of Classification Search ..... 200/5 B, 200/5 E, 310–317, 330–332, 50.36, 461, 200/552; 341/176
See application file for complete search history.

(56) References Cited

U.S. PATENT DOCUMENTS 2,760,014 A * 8/1956 Euler ..... 200/5 E
3,331,933 A * 7/1967 Smith et al. ..... 200/461
4,737,609 A 4/1988 Yuhasz et al.
5,637,930 A 6/1997 Rowen et al.
5,994,652 A * 11/1999 Umemura ..... 200/5 B
7,105,763 B2 9/2006 Adams et al.
7,670,039 B2 * 3/2010 Altonen et al. ..... 362/555
7,745,750 B2 6/2010 Hewson et al.
7,837,344 B2 * 11/2010 Altonen et al. ..... 362/85
2007/0096903 A1 5/2007 Hibshman et al.
2009/0251352 A1 10/2009 Altonen et al.

OTHER PUBLICATIONS

Description of Button Assembly for NT-Style Two-Button Wallstations, which were available to the public in 2000, 4 pages.

* cited by examiner

*Primary Examiner* — Edwin A. Leon
(74) *Attorney, Agent, or Firm* — Mark E. Rose; Philip N. Smith; Bridget L. McDonough

(57) ABSTRACT

A control device, such as a wireless remote control for a load control system, comprises a return spring that operates to return multiple buttons to respective idle positions resulting in lower cost and complexity of the remote control. Specifically, the remote control comprises a first button having an edge, and a second button having a flange positioned adjacent the edge of the first button, such that the edge of the first button rests on the flange of the second button. The return spring has a first end fixed in location with respect to the housing and a second end contacting the second button for returning to the second button to an idle position after an actuation of the second button. After an actuation of the first button, the return spring causes the flange of the second button to force the first button back to an idle position.

20 Claims, 7 Drawing Sheets

CONTROL BUTTON HAVING A SINGLE RETURN SPRING FOR MULTIPLE BUTTONS

BACKGROUND OF THE INVENTION

1. Field of the Invention

The present invention relates to a control device, such as a remote control, for a load control system for controlling the amount of power delivered from a source of alternating-current (AC) power to an electrical load, and more particularly, to a button assembly for a thin-profile remote control that has a single return spring for returning multiple buttons to initial states after an actuation of any of the buttons.

2. Description of the Related Art

Control systems for controlling electrical loads, such as lights, motorized window treatments, and fans, are known. Such control systems often use the transmission of radio-frequency (RF) signals to provide wireless communication between the control devices of the system. The prior art lighting control systems include remote controls, such as, table-top and wall-mounted master controls (e.g., keypads) and car visor controls. The master controls of the prior art lighting control system each include a plurality of buttons and transmit RF signals to load control devices (such as dimmer switches) to control the intensities of controlled lighting loads. The master controls may also each include one or more visual indicators, e.g., light-emitting diodes (LEDs), for providing feedback to users of the lighting control system. The car visor controls are able to be clipped to the visor of an automobile and include one or more buttons for controlling the lighting loads of the lighting control system. An example of a prior art RF lighting control system is disclosed in commonly-assigned U.S. Pat. No. 5,905,442, issued on May 18, 1999, entitled METHOD AND APPARATUS FOR CONTROLLING AND DETERMINING THE STATUS OF ELECTRICAL DEVICES FROM REMOTE LOCATIONS, the entire disclosure of which is hereby incorporated by reference.

It is desirable to mount the remote controls of a lighting control system on different surfaces and at different locations, for example, on a table top, to a wall, or to a car visor. If the remote control is attached to a wall with a faceplate mounted around the remote control, it is desirable that the remote control have a thin profile (i.e., a small depth), such a front surface of the remote control does not protrude much farther than a front surface of the faceplate. Therefore, there is a need for a remote control device for a load control system that has a simple construction and a thin profile, such that the remote control may be mounted flat against a wall inside the opening of a faceplate.

SUMMARY OF THE INVENTION

According to an embodiment of the present invention, a remote control comprises a return spring that operates to return multiple buttons to respective idle positions resulting in lower cost and complexity of the remote control. The remote control further comprises a housing having an opening, a first button adapted to be received in the opening of the housing and having an edge, and a second button adapted to be received in the opening of the housing and having a flange positioned adjacent the edge of the first button, such that the edge of the first button rests on the flange of the second button. The return spring has a first end fixed in location with respect to the housing and a second end contacting the second button for returning the second button to an idle position after an actuation of the second button. After an actuation of the first button, the return spring causes the flange of the second button to force the first button back to an idle position.

In addition, a button assembly for a control device is also described herein. The button assembly comprising: (1) a first button having an edge; (2) a second button having a flange positioned adjacent the edge of the first button, such that the edge of the first button rests on the flange of the second button; and (3) a single return spring having a first end contacting a fixed support and a second end contacting the second button for returning the second button to an idle position after an actuation of the second button. After an actuation of the first button, the return spring causes the flange of the second button to force the first button back to an idle position.

Other features and advantages of the present invention will become apparent from the following description of the invention that refers to the accompanying drawings.

DETAILED DESCRIPTION OF THE INVENTION

Figure 1:
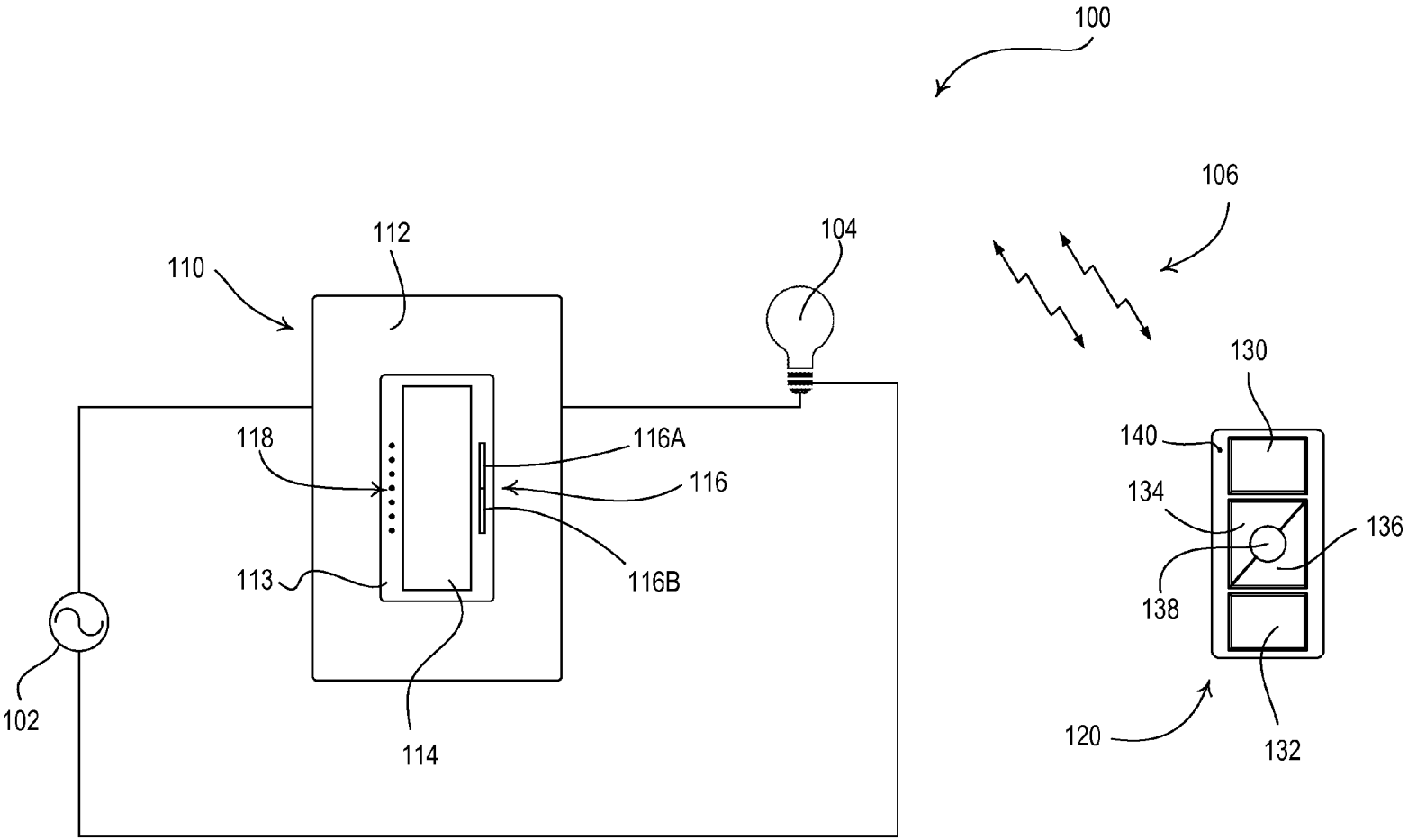
FIG. 1 is a simple diagram of an RF lighting control system comprising a dimmer switch and a remote control.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

FIG. 1 is a simple diagram of an RF load control system 100 comprising a remotely-controllable load control device (e.g., a dimmer switch 110) and a remote control 120. The dimmer switch 110 is coupled in series electrical connection between an AC power source 102 and an electrical lighting load 104 for controlling the amount of power delivered to the lighting load. The dimmer switch 110 is adapted to be wall-mounted in a standard electrical wallbox, and comprises a faceplate 112 and a bezel 113 received in an opening of the faceplate. Alternatively, the dimmer switch 110 could comprise a tabletop dimmer switch (i.e., connected between an electrical outlet and a tabletop or floor lamp) or a screw-in lamp dimmer switch (i.e., connected between a lamp socket of a tabletop or floor lamp and the actual light bulb). In addition, the RF lighting control system 100 may alternatively comprise another type of remotely-controllable load control device, for example, a remotely-controllable electronic dimming ballast, a motor control device, or a motorized window treatment, such as, a roller shade or a drapery.

As shown in FIG. 1, the dimmer switch 110 comprises a toggle actuator 114 (i.e., a control button) and an intensity adjustment actuator 116 (e.g., a rocker switch). Actuations of the toggle actuator 114 toggle, i.e., alternately turn off and on, the lighting load 104. The dimmer switch 110 may be programmed with a preset lighting intensity (i.e., a "favorite" intensity level), such that the dimmer switch is operable to control the intensity of the lighting load 104 to the preset intensity when the lighting load is turned on by an actuation of the toggle actuator 114. Actuations of an upper portion 116A or a lower portion 116B of the intensity adjustment actuator 116 respectively increase or decrease the amount of power delivered to the lighting load 104 and thus increase or decrease the intensity of the lighting load. A plurality of visual indicators 118, e.g., light-emitting diodes (LEDs), are arranged in a linear array on the left-side of the bezel 113. The visual indicators 118 are illuminated to provide feedback of the present intensity of the lighting load 104. The dimmer switch 110 illuminates one of the plurality of visual indicators 118, which is representative of the present light intensity of the lighting load 104. An example of a dimmer switch having a toggle actuator 114, an intensity adjustment actuator 116, and a linear array of visual indicators 118 is described in greater detail in U.S. Pat. No. 5,248,919, issued Sep. 29, 1993, entitled LIGHTING CONTROL DEVICE, the entire disclosure of which is hereby incorporated by reference.

Figure 2A:
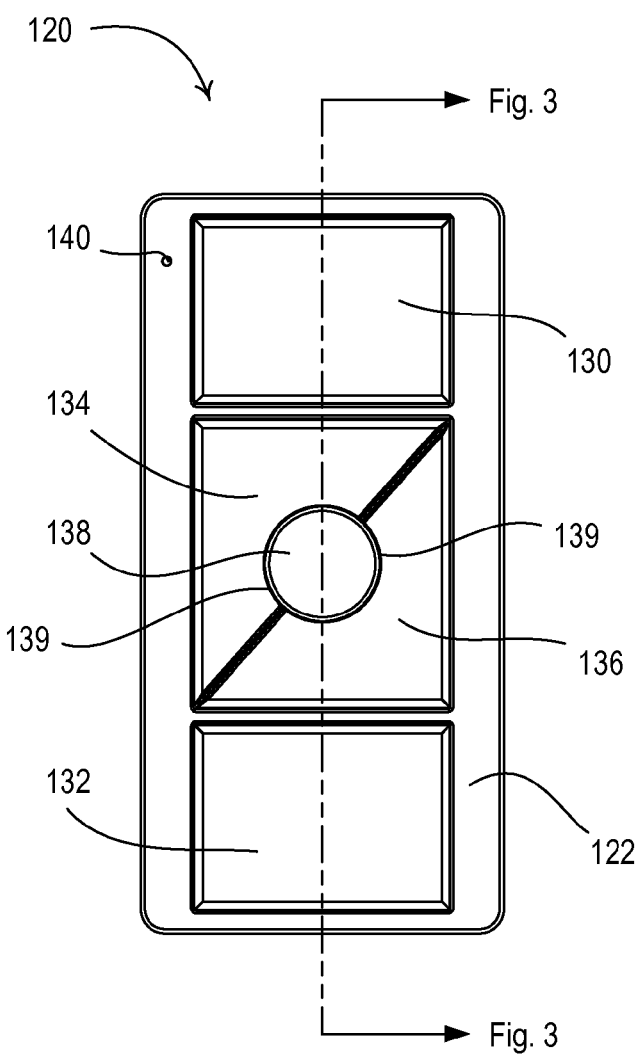
FIG. 2A is a front view of the remote control of the lighting control system of FIG. 1.
Figure 2B:
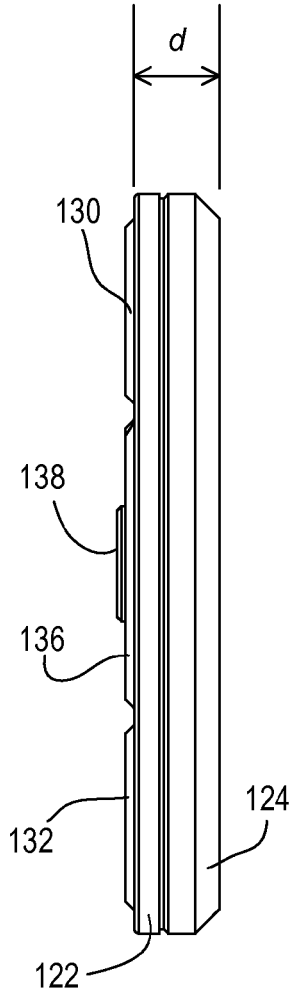
FIG. 2B is a right-side view of the remote control of the lighting control system of FIG. 1.

FIG. 2A is an enlarged front view and FIG. 2B is a right-side view of the remote control 120. The remote control 120 comprises a housing that includes a front enclosure portion 122 and a rear enclosure portion 124. The remote control 120 further comprises a plurality of actuators (i.e., an on button 130, an off button 132, a raise button 134, a lower button 136, and a preset button 138) that are provided in openings of the front enclosure portion. The remote control 120 also comprises a visual indicator 140, which is illuminated in response to the actuation of one of the buttons 130-138. The raise button 134 and the lower button 136 comprise semi-circular edges 139 that together form a circular opening (as shown in FIG. 2A), while the combined periphery of the raise and lower buttons is rectangular. The preset button 138 is circular and is received in the circular opening formed by the semi-circular edges 139 of the raise and lower buttons 134, 136, such that the preset button is surrounded by the raise and lower buttons. The raise button 134 and the lower button 136 meet at the diagonal line of the combined rectangular periphery of the raise and lower buttons.

The remote control 120 transmits packets (i.e., digital messages) via RF signals 106 (i.e., wireless transmissions) to the dimmer switch 110 in response to actuations of any of the actuators. A packet transmitted by the remote control 120 includes, for example, a preamble, a serial number associated with the remote control, and a command (e.g., on, off, preset, etc.). During a setup procedure of the RF load control system 100, the dimmer switch 110 is associated with one or more remote controls 120. The dimmer switch 110 is then responsive to packets containing the serial number of the remote control 120 to which the dimmer switch is associated. The dimmer switch 110 turns on and turns off the lighting load 104 in response to actuations of the on button 130 and the off button 132, respectively. The dimmer switch 110 raises and lowers the intensity of the lighting load 104 in response to actuations of the raise button 134 and the lower button 136, respectively. The dimmer switch 110 controls the lighting load 104 to the preset intensity in response to actuations of the preset button 138. The dimmer switch 110 may be associated with the remote control 120 during a manufacturing process of the dimmer switch and the remote control, or after installation of the dimmer switch and the remote control. The operation of the RF load control system 100 is described in greater detail in co-pending, commonly-assigned U.S. patent application Ser. No. 11/559,166, filed Nov. 13, 2006, entitled RADIO-FREQUENCY LIGHTING CONTROL SYSTEM, and U.S. Pat. No. 7,573,208, issued Aug. 22, 1009, entitled METHOD OF PROGRAMMING A LIGHTING PRESET FROM A RADIO-FREQUENCY REMOTE CONTROL, the entire disclosures of which are hereby incorporated by reference.

Figure 3:
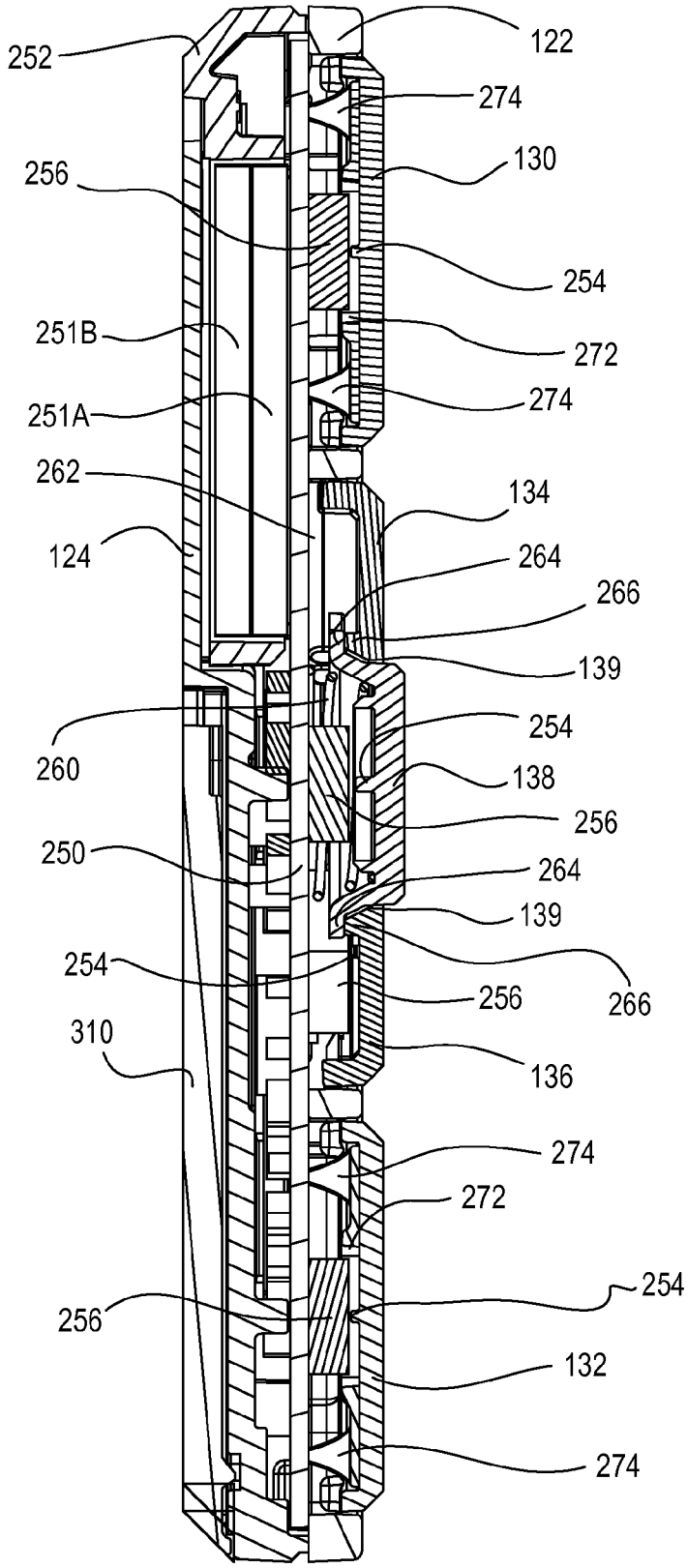
FIG. 3 is a left-side cross-sectional view of the remote control of FIG. 1 taken through the center of the remote control.

FIG. 3 is a left-side cross-sectional view of the remote control 120 taken through the center of the remote control as shown in FIG. 2A. The electrical circuitry of the remote control 120 is mounted to a printed circuit board (PCB) 250, which is fixedly housed between the front enclosure portion 122 and the rear enclosure portion 124. Two series-coupled batteries 251A, 251B provide a DC voltage (e.g., 6V) for powering the electrical circuitry of the remote control 120. The batteries 251A, 251B are located in a battery enclosure portion 252 and are electrically coupled to the circuitry on the PCB 250. The battery enclosure portion 252 is slidably received in the rear enclosure portion 124, such that the battery enclosure portion may be pulled away from the rear enclosure portion to allow for replacement of the batteries 251A, 251B.

Figure 4B:
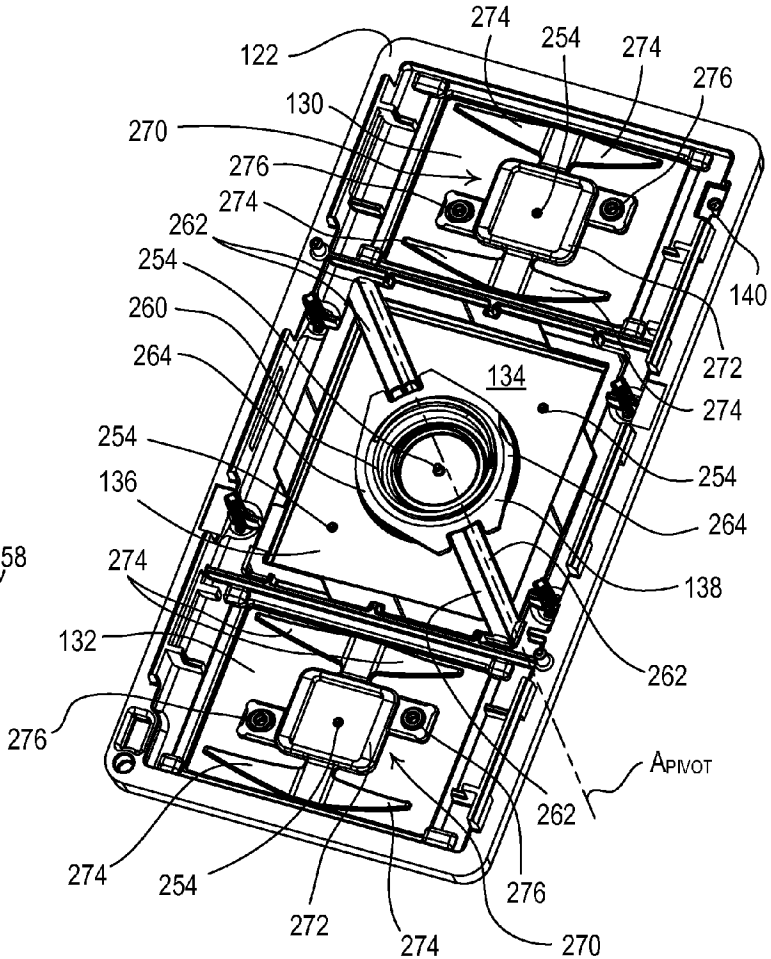
FIG. 4B is a rear perspective view of a front enclosure portion and a plurality of buttons of the remote control of FIG. 1.
Figure 4A:
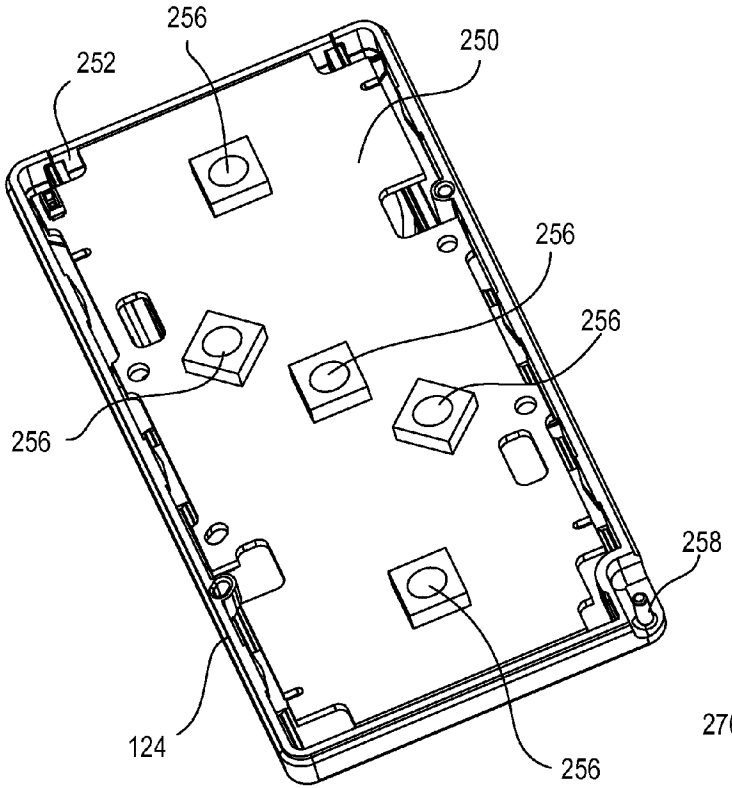
FIG. 4A is a front perspective view of a rear enclosure portion and a printed circuit board of the remote control of FIG. 1.

FIGS. 4A and 4B show the remote control 120 in a partially-disassembled state. Specifically, FIG. 4A is a front perspective view of the rear enclosure portion 124 and the PCB 250, and FIG. 4B is a rear perspective view of the front enclosure portion 122 and the buttons 130-138. The on button 130, the off button 132, the raise button 134, the lower button 136, and preset button 138 comprise actuation posts 254 for actuating mechanical tactile switches 256 mounted on the PCB 250. The remote control 120 comprises a preset button return spring 260 having a first end contacting the PCB 250 and a second end contacting the preset button 138, such that the return spring is positioned between the PCB and the preset button (as shown in FIG. 3). For example, the preset button return spring 260 may comprise a coil spring that surrounds the respective mechanical tactile switch 256 on the PCB 250 and the actuation post 254 on the preset button 138. The PCB 250 acts as a fixed support for the preset button return spring 260. After the preset button 138 is actuated, the preset button return spring 260 operates to return the preset button to an idle position. The idle position of the preset button 138 is a position in which no forces external to the remote control 120 are acting upon the preset button, i.e., the position that the button returns to when the button is not being actuated and the actuation post 256 is not contacting the respective mechanical tactile switch 256. When the preset button 138 is in the idle position, the front surface of the preset button may be approximately parallel to the front surface of the front enclosure portion 122.

The raise button 134 and the lower button 136 further comprise pivoting structures 262 that rest on the PCB 250 (as shown in FIG. 3). As shown in FIG. 4B, the pivoting structures 262 define linear pivoting edges about which the raise and lower buttons 134, 136 are operable to pivot when the buttons are actuated. For example, the pivoting structure 262 of the raise button 134 is displaced along an axis $A_{PIVOT}$, such that the raise button is operable to pivot about the axis $A_{PIVOT}$ when the raise button is pressed down towards the PCB 150 to actuate the respective mechanical tactile switch 256.

According to an embodiment of the present invention, the preset button return spring 260 (that is positioned below the preset button 138) also operates to return the raise and lower buttons 134, 136 to their respective idle positions after an actuation of either of the raise or lower buttons. The preset button 138 comprises flanges 264 on which respective edges 266 of the raise and lower buttons 134, 136 rest (as shown in FIG. 3). As shown in FIG. 4B, the preset button 138 comprises two separate flanges 264. However, the preset button 138 could alternatively comprise a single flange that surrounds the preset button.

When, for example, the raise button 134 is depressed, the raise button pivots about the respective pivoting structure 262 along the pivot axis $A_{PIVOT}$ and the actuation post 254 of the raise button actuates the mechanical tactile switch 254 under the raise button. At this time, the edge 266 of the raise button 134 contacts the respective flange 264 of the preset button 138 and the preset button return spring 260 does compress slightly. Since the pivoting structure 262 of the raise button 134 rests on the PCB 150, the pivoting structure prevents the preset button return spring 260 from being fully compressed, thus preventing the actuation post 256 of the preset button 138 from contacting the mechanical tactile switch 254 under the preset button when the raise button is depressed.

When the raise button 134 is subsequently released, the preset return spring 260 causes the flange 264 of the preset button 138 to contact the respective edge 266 of the raise button 134 to force the raise button back to the idle position (e.g., in which the front surface of the raise button is approximately parallel to the front surface of the front enclosure portion 122). Accordingly, a single return spring (i.e., the preset button return spring 260) is operable to cause multiple buttons (i.e., the preset button 138, the raise button 134, and the lower button 136) to return to their respective idle positions. Thus, additional return springs are not required for the raise and lower buttons 134, 136, resulting in lower cost and complexity of the remote control 120.

The remote control 120 further comprises return springs 270 connected to the bottom sides of the on button 130 and the off button 132 (as shown in FIG. 4B). The springs 270 each comprise square base portions 272 that are positioned adjacent bottom sides of the on button 130 and the off button 132. The base portions 272 have openings for receiving the corresponding mechanical switches 256 on the PCB 250, such that the actuation posts 254 can actuate the mechanical switches when the on button 130 and the off button 132 are actuated. The return springs 270 comprise legs 274 that extend from the base portions 272 to contact the PCB 250 (as shown in FIG. 3). When the on button 130 or the off button 132 is pressed, the legs 274 flex allowing the button to be depressed and the respective actuation post 254 to actuate the mechanical switch 256. When the respective button 130, 132 is then released, the return spring 270 forces the button away from the PCB 250 (i.e., returns the button to an idle position). The springs 270 have attachment openings 276 that are, for example, heat-staked to the bottom sides of the on button 130 and the off button 132.

Figure 5:
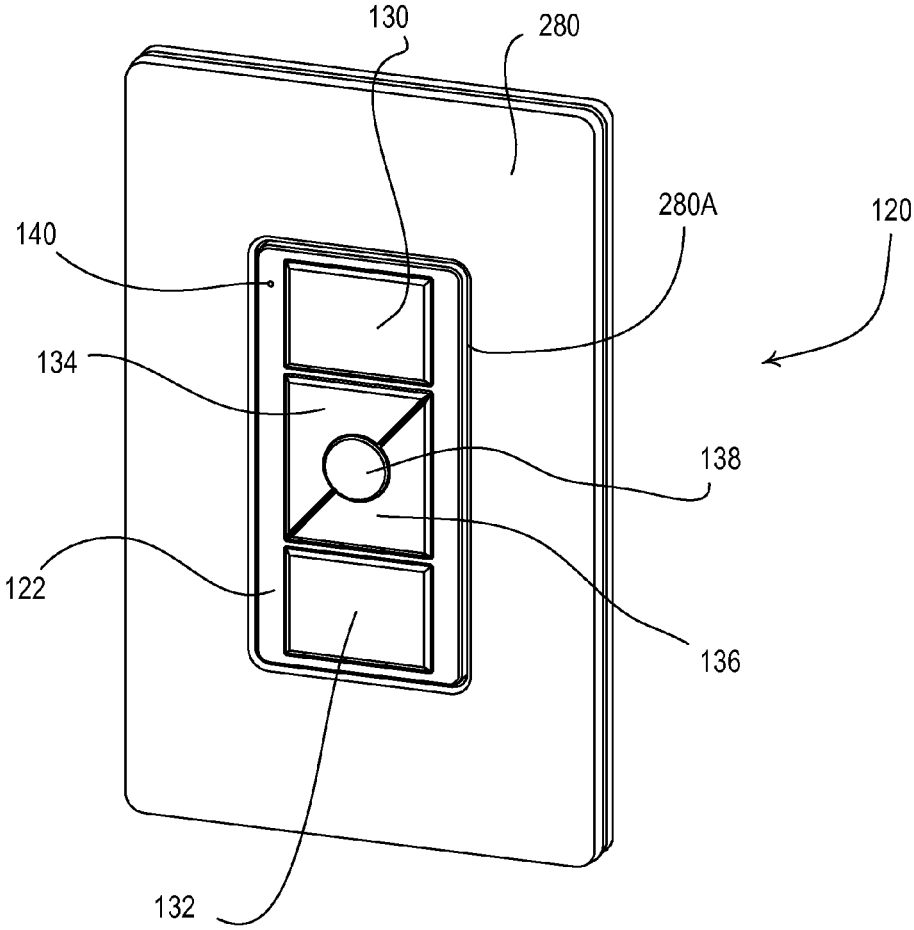
FIG. 5 is a perspective view of the remote control of FIG. 1 mounted to a vertical surface inside an opening of a standard-sized faceplate.
Figure 6:
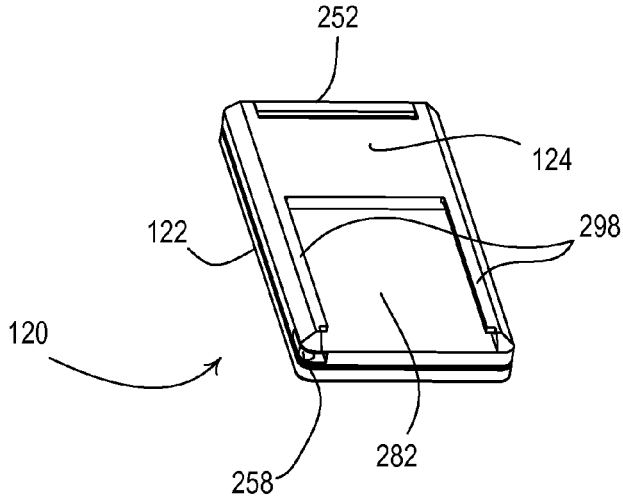
FIG. 6 is a rear perspective view of the remote control of FIG. 1 showing a slide-receiving portion.
Figure 7:
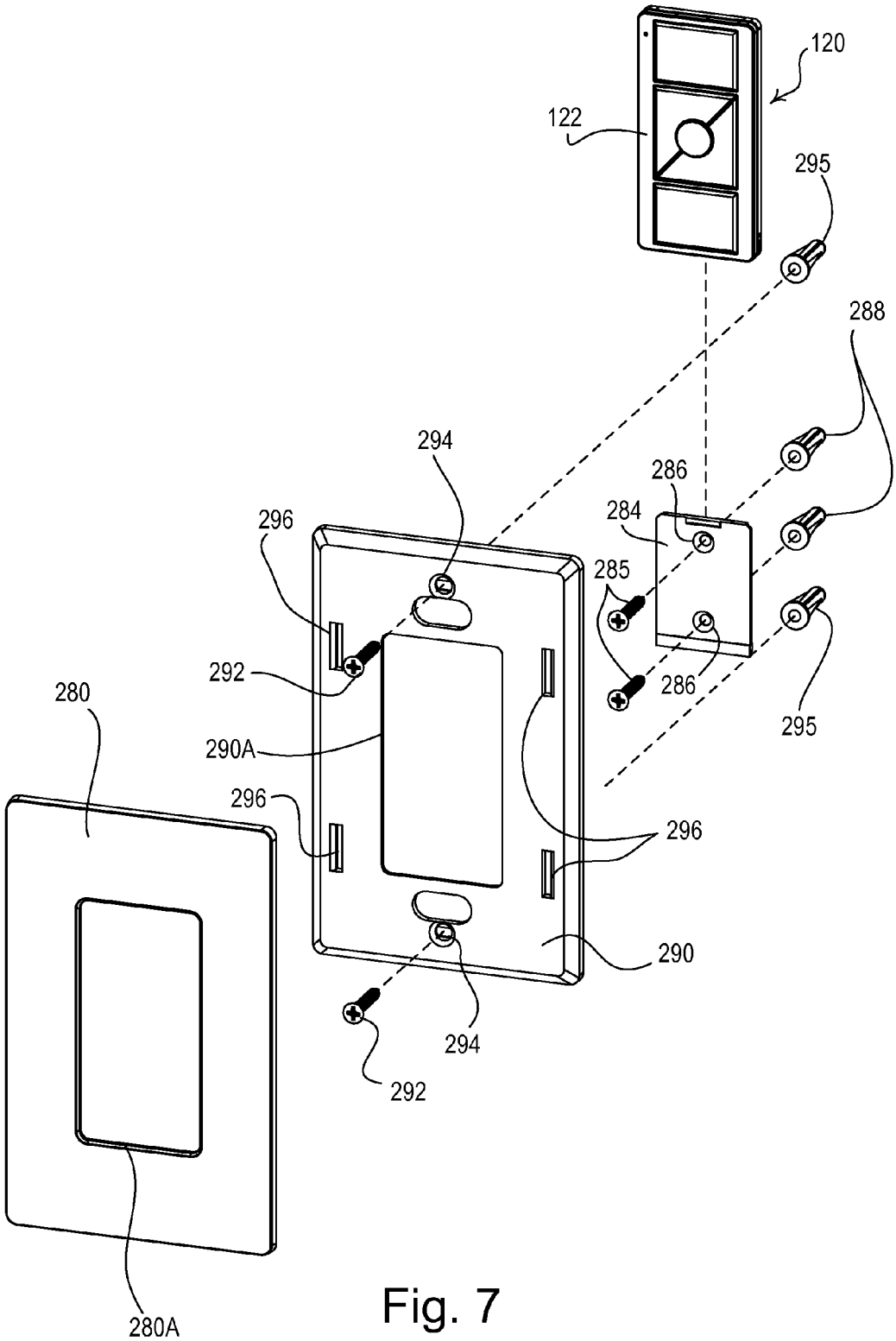
FIG. 7 is a rear perspective view of the remote control of FIG. 1 showing how the slide-receiving portion is adapted to receive a slide-mount plate so that the remote control may be mounted to a vertical surface as shown in FIG. 5.

FIG. 5 is a perspective view of the remote control 120 mounted to a vertical surface (such as, a wall) inside an opening 280A of a standard-sized faceplate 280 (which may be the same as the faceplate 112 of the dimmer switch 110). FIG. 6 is a rear perspective view of the remote control 120 showing a slide-receiving portion 282 of the rear enclosure portion 124. FIG. 7 is a perspective view of the remote control 120 showing how the slide-receiving portion 282 is adapted to receive a slide-mount plate 284 so that the remote control may be mounted to the vertical surface. Screws 285 are received through attachment holes 286 of the slide-mount plate 284 and attached to anchors 288 provided in the wall. Alternatively, the slide-mount plate 284 could have an adhesive on the side facing the wall for attaching the plate to the wall. An adapter 290 is attached to the wall via screws 292 received through attachment holes 294 and attached to anchors 295 provided in the wall. The adapter 290 has an opening 290A that is aligned with the opening 280A of the faceplate 280 when the faceplate is attached to the adapter. In order to attach the faceplate 280 to the adapter 290, the faceplate includes snaps (not shown) that are coupled to snap openings 296 of the adapter. The faceplate 280 and the adapter 290 are described in greater detail in U.S. Pat. No. 4,835,343, issued May 30, 1989, entitled TWO-PIECE FACE PLATE FOR WALL BOX MOUNTED DEVICE, the entire disclosure of which is hereby incorporated by reference. Alternatively, the faceplate 280 could comprise attachment holes, such that the faceplate could be adapted to be mounted (i.e., screwed) directly to the wall without the adapter 290.

When the remote control 120 is mounted on the slide-mount plate 284 and the faceplate 280 is coupled to the adapter 290, the on button 130, the off button 132, the raise button 134, the lower button 136, and the preset button 138 of the remote control 120 are provided through the opening 290A of the adapter and the opening 280A of the faceplate. As shown in FIG. 6, the slide-receiving portion 282 of the remote control 120 comprises two parallel flanges 298 for holding the remote control on the slide-mount plate 284 when the slide-mount plate is received in the slide-receiving portion. Since the rear enclosure portion 124 slides onto the slide-mount plate 284 and the faceplate 280 mounts around the housing (i.e., the front enclosure portion 122 and the rear enclosure portion 124), the remote control 120 is held in place within the opening 280A of the faceplate and the opening 290A of the adapter 290. To mount the remote control 120 to the wall, the remote control is first attached to the slide-mount plate 284 before the adapter 290 is attached to the wall. When the remote control 120 is mounted in the opening 290A of the adapter 290, the remote control is prevented from being decoupled from the slide-mount plate 284 by the adapter since the remote control is surrounded by the opening of the adapter. Therefore, if the remote control 120 is mounted to a wall in a public space, theft of the remote control is discouraged since the remote control cannot be removed from the installation without the use of a tool (i.e., a screwdriver).

The faceplate 280 may be a standard, "off-the-shelf" faceplate, i.e., the opening 280A defines standard dimensions. For example, the faceplate 280 may comprise a designer-style faceplate defining a standard-sized opening. Per standards set by the National Electrical Manufacturers Association (NEMA), the opening of a designer-style faceplate has a length of 2.630" and a width of 1.310" (NEMA Standards Publication No. WD6, 2001, p. 5). Accordingly, the front enclosure portion 122 and the rear enclosure portion 124 are dimensioned such that the remote control 120 is adapted to fit snugly within the opening 280A of the faceplate 280. The outer periphery of the housing (i.e., the front enclosure portion 122 and the rear enclosure portion 124) has a length and a width slightly smaller than the length and the width of the opening 280A of the faceplate 280, such that the outer periphery of the housing is easily received within the opening of the faceplate. For example, the remote control 120 may have a length of approximately 2.605" and a width of approximately 1.280".

Further, the remote control 120 has a depth d (as shown in FIG. 2B), which is sized such that the front surface of the remote control is flush with or does not protrude very far past the front surface of the faceplate 280. Therefore, the depth d is approximately equal to the distance between the front surface of the faceplate 280 and the wall, e.g., less than approximately 0.5", or specifically, equal to approximately 0.3029".

Figure 8:
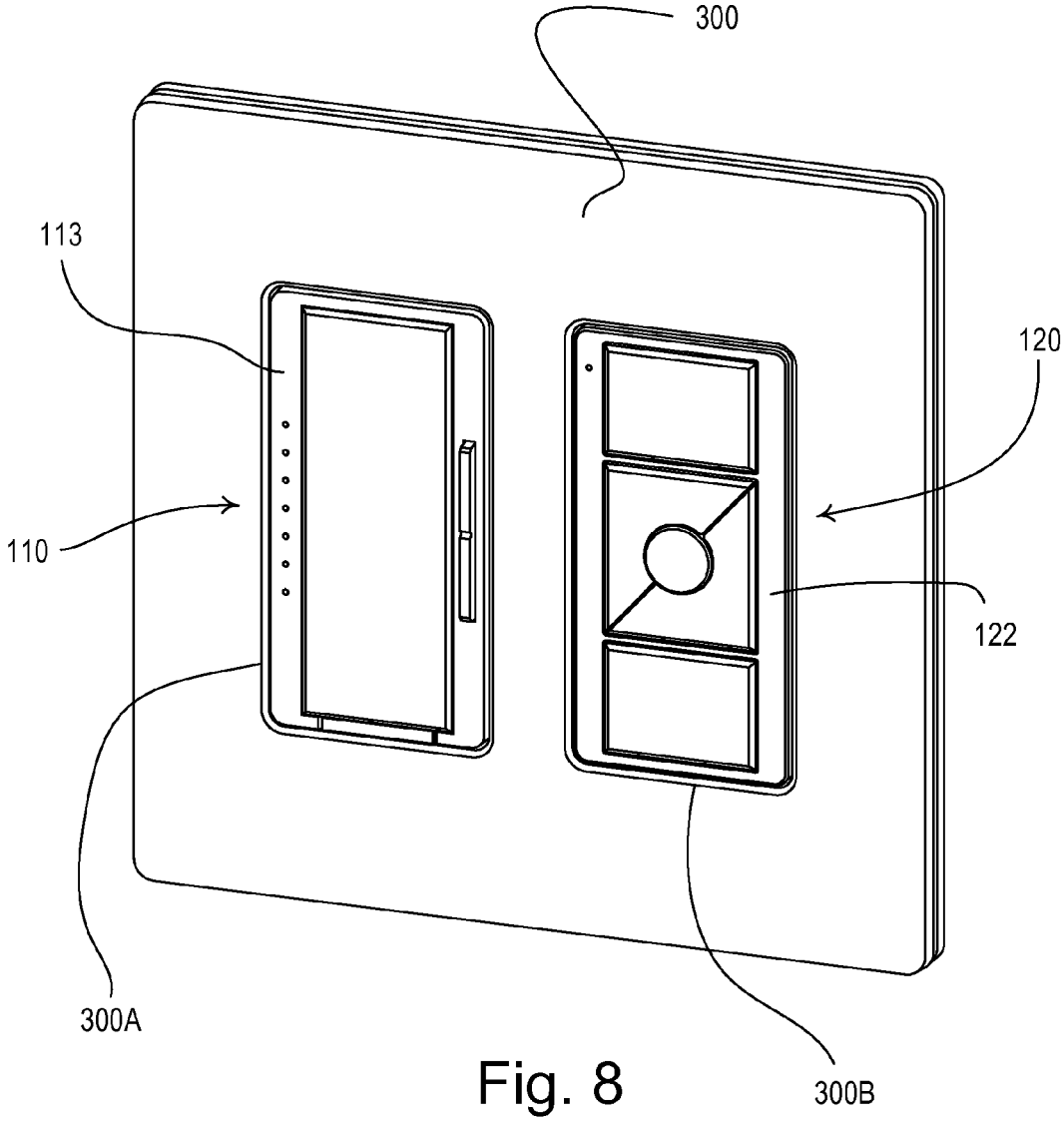
FIG. 8 is a perspective view of the remote control of FIG. 1 ganged next to a designer-style dimmer switch and mounted with a standard designer-style two-gang faceplate.

Accordingly, the remote control 120 may be ganged next to a designer-style load control device (e.g., the dimmer switch 110) with a standard designer-style multi-gang faceplate (e.g., a two-gang faceplate 300) as shown in FIG. 8. The dimmer switch 110 is mounted to a standard electrical wallbox (not shown) that is provided in the wall. The remote control 120 may be mounted to the wall immediately adjacent the electrical wallbox of the dimmer switch 110. The two-gang faceplate 300 has first and second designer-style openings 300A, 300B and is mounted such that the bezel 113 of the dimmer switch 110 is provided in the first opening 300A and the remote control 120 is provided in the second opening 300B. The bezel 113 of the dimmer switch 110 has a length and a width slightly smaller than the length and the width of the first opening 300A of the faceplate 300. The mounting methods of the remote control 120 are described in greater detail in U.S. patent application Ser. No. 12/399,126, filed Mar. 6, 2009, entitled WIRELESS BATTERY-POWERED REMOTE CONTROL HAVING MULTIPLE MOUNTING MEANS, the entire disclosure of which is hereby incorporated by reference.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A control device comprising:

a housing having an opening;

a first button adapted to be received in the opening of the housing and having an edge;

a second button adapted to be received in the opening of the housing and having a flange positioned adjacent the edge of the first button, such that the edge of the first button rests on the flange of the second button; and a return spring having a first end fixed in location with respect to the housing and a second end contacting the second button for returning the second button to an idle position after an actuation of the second button;

wherein, after an actuation of the first button, the return spring causes the flange of the second button to force the first button back to an idle position.

2. The control device of claim 1, further comprising:

a third button adapted to be received in the opening of the housing and having an edge;

wherein the second button comprises a second flange positioned adjacent the edge of the third button, the edge of the third button resting on the second flange of the second button, such that, after an actuation of the third button, the return spring causes the flange of the second button to force the third button back to an idle position.

3. The control device of claim 2, wherein the edges of first and third buttons are semi-circular and together form a circular opening.

4. The control device of claim 3, wherein the second button is circular and is received in the circular opening formed by the semi-circular edges of the first and third buttons.

5. The control device of claim 4, wherein a periphery formed by the first and third buttons is rectangular.

6. The control device of claim 5, wherein the first and third buttons meet at a diagonal line of the rectangular periphery formed by the first and third buttons.

7. The control device of claim 4, wherein the first and second flanges are connected to form a single flange surrounding the second button.

8. The control device of claim 1, further comprising:

a printed circuit board fixedly mounted inside the housing, the first end of the return spring contacting the printed circuit board, such that the return spring is positioned between the printed circuit board and the second button.

9. The control device of claim 8, wherein the first button comprises a pivoting structure that rests on the printed circuit board, the first button operable to pivot about the pivoting structure when the first button is actuated.

10. The control device of claim 9, wherein, when the first button is depressed, the first edge of the first button contacts the flange of the second button, such that the return spring is slightly compressed.

11. The control device of claim 10, wherein the pivoting structure prevents the return spring from being fully compressed when the first button is depressed.

12. The control device of claim 8, further comprising:

first and second mechanical tactile switches mounted on the printed circuit board;

wherein the first button comprises an actuation post for actuating the first mechanical tactile switch, and the second button comprises an actuation post for actuating the second mechanical tactile switch.

13. The control device of claim 12, wherein the return spring comprises a coil spring positioned between the printed circuit board and the second button, the coil spring surrounding the second mechanical tactile switch on the printed circuit board and the actuation post of the second button.

14. A button assembly for a control device, the button assembly comprising:

a first button having an edge;

a second button having a flange positioned adjacent the edge of the first button, such that the edge of the first button rests on the flange of the second button; and a single return spring having a first end contacting a fixed support and a second end contacting the second button for returning the second button to an idle position after an actuation of the second button;

wherein, after an actuation of the first button, the single return spring causes the flange of the second button to force the first button back to an idle position.

15. The button assembly of claim 14, wherein the fixed support comprises a printed circuit board, the return spring positioned between the printed circuit board and the second button.

16. The button assembly of claim 15, wherein the first button comprises a pivoting structure that rests on the printed circuit board, the first button operable to pivot about the pivoting structure when the first button is actuated.

17. The button assembly of claim 16, wherein, when the first button is depressed, the first edge of the first button contacts the flange of the second button, such that the return spring is slightly compressed.

18. The button assembly of claim 15, further comprising:

first and second mechanical tactile switches mounted on the printed circuit board;

wherein the first button comprises an actuation post for actuating the first mechanical tactile switch, and the and second buttons comprises an actuation post for actuating the second mechanical tactile switch.

19. The button assembly of claim 18, wherein the return spring comprises a coil spring positioned between the printed circuit board and the second button, the coil spring surrounding the second mechanical tactile switch on the printed circuit board and the actuation post of the second button.

20. The button assembly of claim 14, further comprising:

a third button having an edge;

wherein the second button comprises a second flange positioned adjacent the edge of the third button, the edge of the third button resting on the second flange of the second button, such that, after an actuation of the third button, the return spring causes the flange of the second button to force the third button back to an idle position.

* * * * *